US011655073B2

(12) United States Patent
Smith et al.

(10) Patent No.: US 11,655,073 B2
(45) Date of Patent: May 23, 2023

(54) BUCKET

(71) Applicant: Construction Research & Technology GmbH, Trostberg (DE)

(72) Inventors: David A. Smith, Jacksonville, FL (US); Danielle Maria Shacklady McAtee, Shakopee, MN (US)

(73) Assignee: Construction Research & Technology GmbH, Trostberg (DE)

( * ) Notice: Subject to any disclaimer, the term of this patent is extended or adjusted under 35 U.S.C. 154(b) by 67 days.

(21) Appl. No.: 17/050,996

(22) PCT Filed: May 10, 2019

(86) PCT No.: PCT/US2019/031696
§ 371 (c)(1),
(2) Date: Oct. 27, 2020

(87) PCT Pub. No.: WO2019/217801
PCT Pub. Date: Nov. 14, 2019

(65) Prior Publication Data

US 2021/0229868 A1 Jul. 29, 2021

Related U.S. Application Data

(60) Provisional application No. 62/669,428, filed on May 10, 2018.

(51) Int. Cl.
*B65D 25/32* (2006.01)
*B65D 6/34* (2006.01)

(52) U.S. Cl.
CPC ..... *B65D 25/32* (2013.01); *B65D 11/28* (2013.01)

(58) Field of Classification Search
CPC ..... B65D 25/32; B65D 25/2876; B65D 2501/24503; B65D 2501/24484; B65D 11/28
(Continued)

(56) References Cited

U.S. PATENT DOCUMENTS 766,671 A 8/1904 Crawford
2,436,271 A 2/1948 Simmons
(Continued)

FOREIGN PATENT DOCUMENTS

CA 2717284 A1 4/2012
DE 20014646 U1 * 11/2000 ..... B65D 25/2879
DE 202013007410 U1 * 12/2014 ..... B65D 25/32

OTHER PUBLICATIONS

International Search Report for Application No. PCT/US2019/031696 dated Aug. 27, 2019.
(Continued)

*Primary Examiner* — Mollie Impink
(74) *Attorney, Agent, or Firm* — Curatolo, Sidoti & Trillis Co., LPA; Salvatore A. Sidoti; Floyd Trillis, III

(57) ABSTRACT

Provided is a bucket including a bucket body with an improved handle attachment. The bucket body includes a reinforcing collar extending about the perimeter of the bucket body. A ring is engaged to the bucket body by locating the ring within a channel defined on the exterior surface of the bucket body. The ring extends about the perimeter of the bucket body and engages a pivotable arcuate handle. The engagement of the ring in an annular channel and the handle to the ring results in the even distribution of a lifting force across the ring and reinforcing collar.

16 Claims, 4 Drawing Sheets

(58) Field of Classification Search
USPC ..... 220/317, 760, 769, 773
See application file for complete search history.

(56) References Cited

U.S. PATENT DOCUMENTS

| | | | | | |
|---|---|---|---|---|---|
| 2,494,507 | A * | 1/1950 | Curtis | A47J 47/18 | 220/769 |
| 2,620,006 | A * | 12/1952 | Sorron-Zabala | A47J 47/18 | 220/904 |
| 2,985,335 | A | 5/1961 | Bliss | | |
| 5,292,162 | A | 3/1994 | Korngold | | |
| 6,257,440 | B1 * | 7/2001 | Perkins | B65D 25/32 | 220/760 |
| 6,712,233 | B2 * | 3/2004 | Arshinoff | B65D 21/0219 | 220/276 |
| 8,210,391 | B2 * | 7/2012 | Luburic | B65D 43/0208 | 206/508 |

OTHER PUBLICATIONS

International Written Opinion for Application No. PCT/US2019/031696 dated Aug. 27, 2019.

* cited by examiner

BUCKET

CROSS REFERENCE TO RELATED APPLICATIONS

This application is a national stage application of International Application No. PCT/US2019/031696, filed 10 May 2019, which claims priority from U.S. Provisional Patent Application No. 62/669,428, filed 10 May 2018, both of which applications are incorporated herein by reference.

TECHNICAL FIELD

The present disclosure relates to an improved handle attachment for a bucket and a bucket including the attached handle.

BACKGROUND

Many liquid-applied building materials such as air/weather resistive barriers, adhesives, binders, coatings, finishes, mastics, paints, primers, sealants, and waterproofing compositions are supplied to the contractor in 5-gallon buckets. For example, exterior wall cladding systems such as exterior insulation and finish systems (EIFS) and stucco wall systems employ wet base and finish coatings that are generally supplied to the contractor in 5-gallon buckets.

The 5-gallon buckets containing liquid-applied building materials are bulky and heavy. When liquid applied coatings are applied to a vertical building wall substrate of a tall building structure it is necessary to first hoist the 5-gallon buckets containing the coating to overhead scaffolding at the job site. Lifting the heavy 5-gallon buckets to the point of application at the job-site is cumbersome for the contractor and involves a risk of human injury and loss of product.

There are significant safety considerations when hoisting these buckets to overhead scaffolding on job sites. Buckets known in the art are generally hoisted from the top of the bucket, which is bearing the weight of the pail, and the weight is borne entirely at two points of attachment.

This leads to many problems and safety concerns. With a handle inserted into two points at the top of a plastic collar, relatively little force on the handle can dislodge the handle from the points of attachment. Further, with the points of attachment being so near the top of the bucket, any movement at or near the bottom of the bucket is amplified due to having greater leverage.

BRIEF DESCRIPTION OF THE DRAWINGS

The accompanying drawings are included to provide a further understanding of the handle and bucket disclosed herein, and are incorporated in and constitute a part of this specification. The drawings depict various illustrative embodiments of the handle and bucket disclosed herein, but are not intended to limit the specification or claims in any manner whatsoever.

SUMMARY

Figure 1:
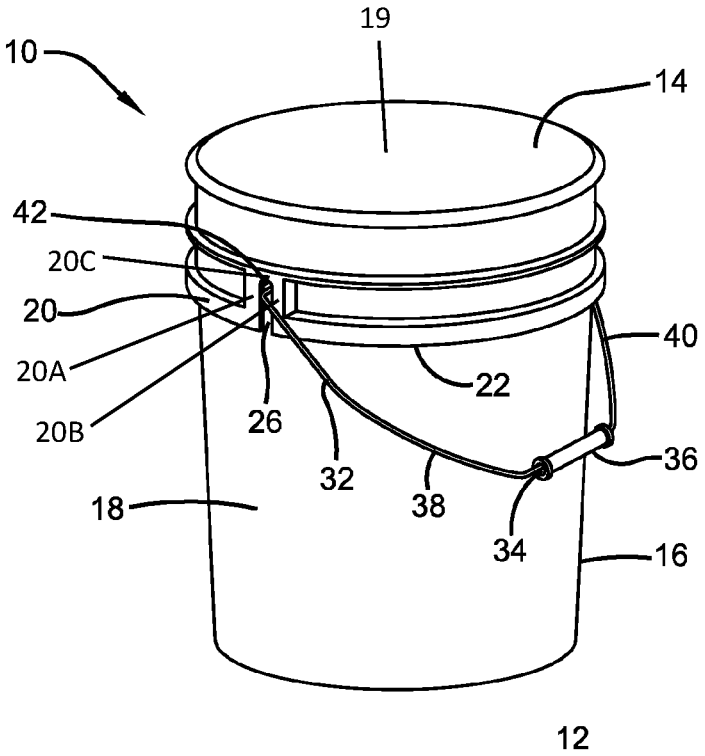
FIG. 1 is a perspective view of an illustrative embodiment of the present disclosure.

Disclosed is a bucket comprising a (i) bucket body including an upstanding continuous sidewall, a bottom wall, an open top, an interior, and an exterior surface, (b) a collar extending outwardly from said exterior surface and around the perimeter of said bucket body, wherein said collar includes axially opposed upstanding slots, (c) a channel defined by said exterior surface of said bucket body and said collar, (d) a ring engaged with said channel, and (e) a handle comprising first and second ends, wherein said handle is pivotably engaged to said ring and wherein said first and second ends are inserted into said upstanding slots.

DETAILED DESCRIPTION

The present embodiments are directed to a bucket comprising a bucket body comprising a side wall, bottom wall, and open top. The bucket body includes an interior and an exterior surface. A collar extends outwardly from the exterior surface of the bucket body. The collar extends around the perimeter of the bucket body. A channel is defined between the exterior surface of the bucket body and the outwardly extending collar. A ring element is engaged with the channel and extends around the perimeter of the bucket body. A bucket handle is pivotably engaged with the ring.

According to certain illustrative embodiments, the bucket body comprises a bottom wall, an open top, and an upstanding continuous sidewall. The upstanding continuous side wall extends substantially vertically between the bottom wall and the rim of the open top of the bucket. The side wall and bottom wall of the bucket body define an interior for holding a desired quantity of a material. The side wall of the bucket body includes opposite facing interior and exterior surfaces. A collar extends outwardly from the exterior surface of the side wall of the bucket body and around the perimeter of the bucket body. The collar may comprise a continuous collar that extends around the perimeter of the bucket body. According to alternative embodiments, the collar may comprise a discontinuous collar extending outwardly from the exterior surface and about the perimeter of the bucket body. The difference between a continuous collar and a discontinuous collar is that the discontinuous collar may include one or more breaks extending around the perimeter of the bucket body, the while continuous collar does not include any breaks about the perimeter of the bucket body.

The bucket body may be provided in a wide variety of geometries. By way of illustration, but not in limitation, the bucket body may be cylindrical, substantially cylindrical, conical, a truncated cone, square, rectangular, or other polygonal cross section.

The collar of the bucket body includes a plurality of upstanding slots. According to certain illustrative embodiments, the collar of the bucket body includes a pair of upstanding slots. According to yet further illustrative embodiments, the pair of upstanding slots are axially aligned. The term "axially aligned" means that the pair of upstanding slots are positioned along an axis extending between the slots. According to certain embodiments where the bucket body is circular or round in cross section, the pair of upstanding slots are diametrically opposed from each other about the perimeter of the bucket body. The outwardly extending collar may be molded or extruded with the bucket body as an integral structure. Alternatively, the collar may be attached to the exterior surface of the bucket body after the extruded or molded bucket body is formed. The collar may constitute one continuous piece extending around the exterior surface of the bucket body or be discontinuous pieces or sections within a plane. The continuous or discontinuous collar may extend about the perimeter of the bucket body in a single plane or substantially within a single plane. According to certain embodiments, the collar extending outwardly from the exterior surface of the bucket body extends around the entire perimeter of the bucket body in a horizontal or substantially horizontal plane. According to further illustrative embodiments, the collar extends outwardly from the exterior surface of a cylindrical bucket body within a horizontal plane.

A channel or groove is defined on the exterior surface of the bucket body. According to certain illustrative embodiments, the channel or groove is defined between the exterior surface of the bucket body and the collar extending outwardly from the exterior surface of the bucket body. According to certain illustrative embodiments, the channel is defined between the exterior surface of the bucket body and the underside of the collar. According to certain embodiments where the bucket body is circular or round in cross section, the channel or groove comprises an annular channel extending around the perimeter of the bucket body.

The axially aligned upstanding slots divide the annular collar into two semicircular portions. Each one of the axially aligned slots are defined by collar portions defining a border around the slots. The border includes two collar portions extending upwardly above the upper horizontal margin of the annular collar. The two upwardly extending collar portions are connected by a connection portion extending between the upper ends of the upwardly extending collar portions. The border defining the axially aligned upstanding slots also defines a continuous channel between the exterior surface of the bucket body and the inner surface of the collar facing the exterior surface of the bucket body. The continuous channel defined by the border is continuous with the remainder of the annual collar extending about the exterior surface of the bucket body.

A ring is engaged with said channel formed on the exterior of the bucket body. The ring may comprise, without limitation, metals, metal alloys (eg, iron, steel, or aluminum) plastic or composite materials. The term "ring" as used in the present specification should not be construed to be limited to circular or round shaped rings. There is no limitation on the geometry of the ring and the term "ring" is intended to be inclusive of a wide variety of geometries including, for example and without limitation, elliptical, oblong, oval, polygonal, rectangular, or square geometries. According to certain illustrative embodiments, the ring is circular in shape. According to certain illustrative embodiments, the ring is circular in shape and is manufactured from a metal alloy. The annular ring is configured to extend about the outer perimeter of the bucket body substantially in the same horizontal plane such that it can be inserted into and engaged with the annular channel defined by the bucket body and annular collar. According to certain embodiments, the circular ring includes substantially horizontally extending semicircular ring portions and a pair of axially aligned ring peak portions. The ring peak portions extend upwardly above the upper horizontal margin of the ring. The ring peak portions may be formed from ring portions that extend upwardly and inwardly from the horizontally extending ring portions toward each other and which connect at an apex. The apex may comprise a point, rounded surface, or any other suitable geometry. The ring peak portions are configured to be inserted into and engage with portions of the channel defined by the border surrounding the upstanding slots of the annular collar of the bucket body.

The ring may include an unlimited number of other geometries. By way of example, but not in limitation, for embodiments where the bucket body is squared shaped in cross section, the channel and ring extending about the perimeter of the bucket body are also square in shape.

The ring is positioned within the channel defined by the exterior surface of the bucket body and the outwardly extending collar, and circumscribes the exterior surface of the bucket body. When the bucket is lifted overhead, the ring distributes a lifting force across the collar of the bucket body, thereby providing stability during the bucket lifting process. During the lifting operation, the weight of the bucket is distributed around the bucket by the collar and ring and therefore the handle bears less weight. Stability is improved, as movement at the bottom of the bucket body has less leverage. This enables safer and more efficient handling of a bucket on a job site and during transportation, in particular, if the bucket is being lifted by a pulley to overhead scaffolding.

The bucket includes a handle that is pivotably engaged to the bucket body via the ring. The pivotable handle comprises a substantially arcuate handle having a comfort or gripping portion and first and second ends. According to certain illustrative embodiments, the arcuate handle comprises a gripping region and arm portions extending away from opposite ends of the gripping region, where the arm portions terminate in opposite first and second ends. In certain illustrative embodiments, the arms terminate in hook-shaped ends. Each of the first and second ends are independently inserted into one of the slots of the pair of axially aligned upstanding slots of the channel. The first and second ends of the bucket handle are inserted into the upstanding slots of the annular collar and pivotably engage the ring at or near the apex portion of the ring axially aligned ring peaks.

The bucket handle may include a comfort element engaged with the handle. The comfort element may be selected from soft plastics, hard plastics, composite materials, foams, or any other suitable material known in the art. The comfort element may be provided as a cylindrically-shaped element having a smooth outer surface. The cylindrically-shaped comfort element may be coaxially fitted over the gripping region of the bucket handle and may also be freely rotatable about the gripping region of the bucket handle. Alternatively, the comfort element may be friction fitted or snap-fitted onto the bucket handle in the gripping region. According to certain illustrative embodiments, the comfort element may include grooves for placement of the fingers of a human hand. The comfort element may also include means for securing the bail handle of the bucket to a machine such as a pulley.

The bucket handle comprises a center region, wherein lifting the bucket from the center region distributes the weight of the bucket substantially evenly across the collar. Lifting the bucket from the center region of the bail handle results in lifting the ring element that is engaged in the channel defined by the outwardly extending collar. By virtue of its engagement with the collar, as the bucket body is being lifted, the ring distributes the lifting force evenly or substantially evenly across the outwardly extending collar. As the collar extends around the entire perimeter of the bucket body, then bucket can be stably lifted to overhead scaffolding for application on a vertical building wall.

The bucket body may be made from a wide variety of non-limiting materials. By way of illustration, but not in limitation, the bucket body may be made from polymer materials and reinforced polymer materials. According to certain embodiments, the bucket body may be made from a fiber reinforced polymer material. Suitable polymer materials from which the bucket body may be made include high density polyethylene, polyethylene, polyvinyl chloride, polystyrene, polypropylene, polyethylene terephthalate, and combinations thereof.

According to certain embodiments, without limitation, the weight of the bucket containing building material such as paints, primers, or other coatings is from about 0.5 pounds to about 100 pounds, or about 10 to about 90 pounds, or about 20 to about 80 pounds, or about 30 to about 70 pounds or about 40 to about 60 pounds.

A vertical distance is defined along the upstanding side wall extending between the bottom wall and the open top of the bucket body. According to certain embodiments, the collar extending outwardly from the exterior surface of the bucket body is located between from about 50% to about 100% of said distance from the bottom wall to open top of the bucket body. According to other embodiments, the collar is located between from about 60% to about 95% of said distance from the bottom wall to the open top of the bucket body, between from about 70% to about 90% of said distance from the bottom wall to the open top of the bucket body, or between from about 75% to about 90% of said distance from the bottom wall to the open top of the bucket body, or between from about 80% to about 90% of said distance from the bottom wall to the open top of the bucket body.

Also provided is a method of lifting a bucket to an overhead location. The method includes engaging the bucket disclosed herein with suitable lifting equipment or machine, and lifting the bucket to a desired overheard location. According to certain embodiments, the method includes engaging the bucket disclosed herein with suitable lifting equipment or machine and lifting the bucket to a desired overheard scaffolding structure.

According to certain embodiments, the method for lifting the bucket to an overhead location comprises engaging a bucket comprising a (i) bucket body including an upstanding continuous sidewall, a bottom wall, an open top, an interior, and an exterior surface, (b) a collar extending outwardly from said exterior surface and around the perimeter of said bucket body, (c) a channel defined by said exterior surface of said bucket body and said collar, wherein said channel includes axially opposed upstanding slots, (d) a ring engaged with said channel, and (e) a handle comprising first and second ends, wherein said handle is pivotably engaged to said ring and wherein said first and second ends are inserted into said upstanding slots with suitable lifting equipment or machine, and lifting the bucket to a desired overheard location.

According to certain embodiments, the method for lifting the bucket to an overhead location comprises engaging a bucket comprising a (i) bucket body including an upstanding continuous sidewall, a bottom wall, an open top, an interior, and an exterior surface, (b) a collar extending outwardly from said exterior surface and around the perimeter of said bucket body, (c) a channel defined by said exterior surface of said bucket body and said collar, wherein said channel includes axially opposed upstanding slots, (d) a ring engaged with said channel, and (e) a handle comprising first and second ends, wherein said handle is pivotably engaged to said ring and wherein said first and second ends are inserted into said upstanding slots with suitable lifting equipment or machine, and lifting the bucket to a desired overheard scaffolding structure.

A pulley may be used to lift the bucket disclosed herein to a desired overhead location. The pulley may be a singular pulley, multiple pulleys, or a system of pulleys such as, without limitation, a hoist. The belt of the at least one pulley may be, without limitation, a chain, synthetic or natural rope, or leather. According to certain embodiments and without limitation, the pulley may be attached to or proximate to an overhead scaffolding structure.

FIG. 1 shows an illustrative embodiment of the bucket 10. Bucket 10 is depicted in this embodiment as a cylindrical 5-gallon bucket suitable for containing liquid construction coatings. The bucket 10 includes a bottom wall 12, an open top 14 and an upstanding side wall 16 extending between the bottom wall 12 and open top 14. The side wall 16 has an outer surface 18 and inner surface 19. On the outer surface 18 of the side wall 16 is a collar 20 that extends around the entire perimeter of the bucket 10. The collar 20 has two collar portions extending upwardly (20A, 20B) above the horizontal margin of the collar 20, with a connection portion (20C) extending therebetween. A continuous annular channel 22 is defined between the outer surface 18 of the bucket 10 and the collar 20. Annular channel also includes a pair of axially aligned upstanding slots 26, 28. A continuous metal alloy ring 30 is engaged with the annular channel 22. A bucket handle 32 includes a center gripping region 34 and a comfort grip 36 located at or near the center gripping region 36 of the bucket handle 32. The bucket handle 32 is arcuate in shape and includes arms 38, 40 extending downwardly in opposite directions from the center gripping region 36 of the handle 32. Arms 38, 40 terminate in first 42 and second 44 handle ends.

Figure 2:
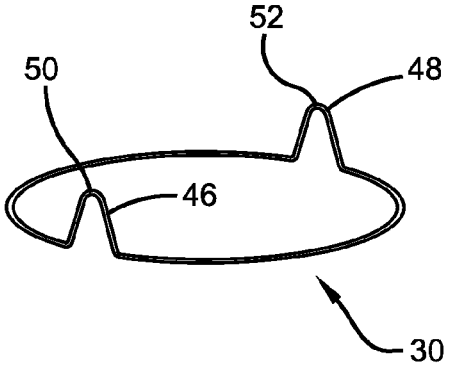
FIG. 2 is a perspective view of an illustrative embodiment of the ring of the bucket.

FIG. 2 shows the ring 30 of the bucket 10. According to certain embodiments, the ring 30 may be manufactured as one continuous piece of material. According to other embodiments, the ring may comprise more than one piece or section of material that are joined together by a suitable joining method or joining material to form the ring 30 that extends about the entire perimeter of the exterior surface 18 of the bucket 10. The ring 30 is configured to be positioned within the channel 22 located underneath the collar 20 of the bucket 10 of FIG. 1. The ring 30 includes a pair of axially aligned ring peaks 46, 48. Ring peaks 46, 48 constitute points of engagement 50, 52 for engaging the first 42 and second 44 terminal ends of the bucket handle 32.

Figure 3:
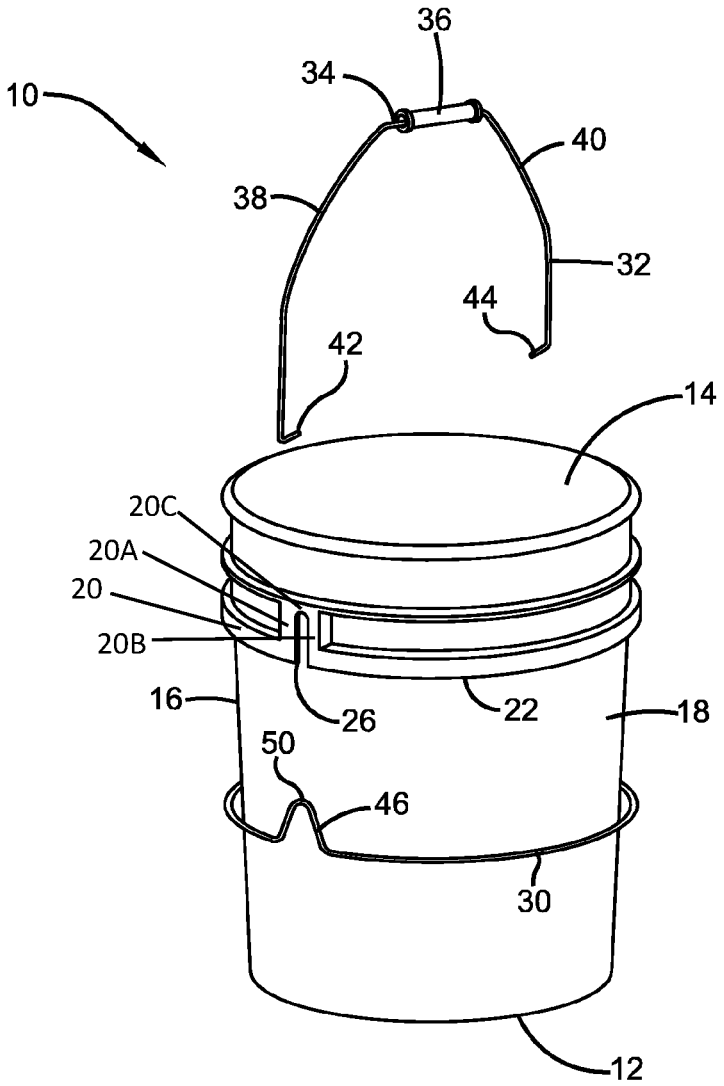
FIG. 3 is an exploded view of one illustrative embodiment of the bucket.

FIG. 3 is an exploded view of one embodiment of the bucket 10. Bucket 10 is depicted in this embodiment as a cylindrical 5-gallon bucket suitable for containing liquid construction coatings. The bucket 10 includes a bottom wall 12, an open top 14 and an upstanding side wall 16 extending between the bottom wall 12 and open top 14. The side wall 16 has an outer surface 18 and inner surface 19. On the outer surface 18 of the side wall 16 is a collar 20 that extends around the entire perimeter of the bucket 10. The collar 20 has two collar portions extending upwardly (20A, 20B) above the horizontal margin of the collar 20, with a connection portion (20C) extending therebetween. A continuous annular channel 22 is defined between the outer surface 18 of the bucket 10 and the collar 20. Annular channel also includes a pair of axially aligned upstanding slots 26, 28. A continuous metal alloy ring 30 is engaged with the annular channel 22. A bucket handle 32 includes a center gripping region 34 and a comfort grip 36 located at or near the center gripping region 36 of the bucket handle 32. The bucket handle 32 is arcuate in shape and includes arms 38, 40 extending downwardly in opposite directions from the center gripping region 36 of the handle 32. Arms 38, 40 terminate in first 42 and second 44 handle ends. When the bucket handle 32 is attached to the ring 30 the handle 32 may be lifted, which will lift the entire bucket 10. The handle 32 may be lifted, for example and without limitation, from a position at or near the center gripping region 36 of the handle 32. When the bucket 10 is lifted in this way, the weight of the bucket 10 is distributed substantially evenly around the collar 20 by the ring 30.

Figure 4:
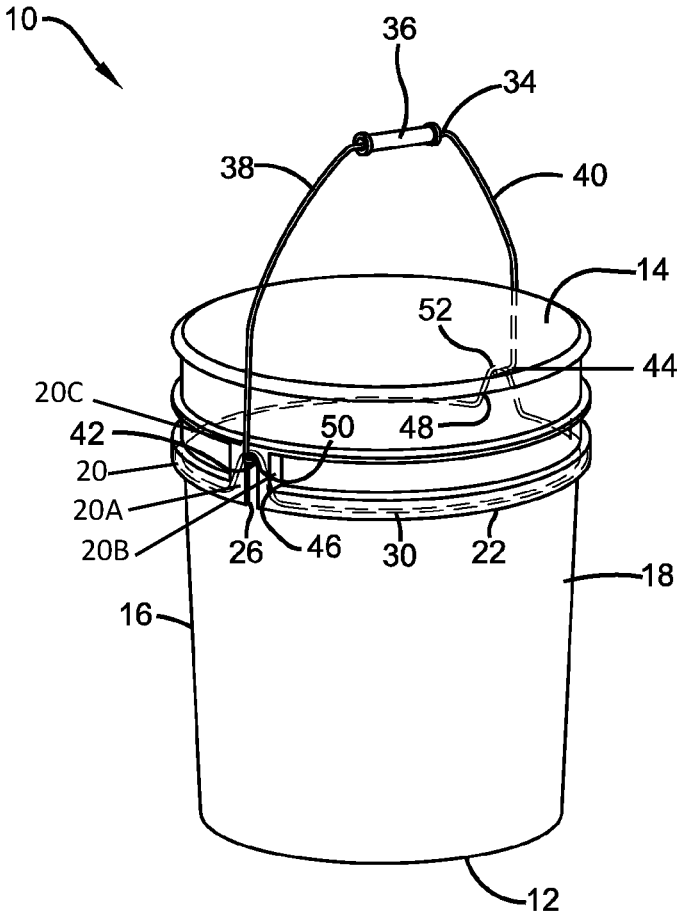
FIG. 4 is a view showing the circumscribing ring of the present embodiments.

FIG. 4 shows the continuous ring 30 of the bucket 10. The ring 30 circumscribes or encircles the bucket 10 on the outer surface 18 of the upstanding side wall 16. The ring 30 includes loop portions 31, 33 and a pair of axially aligned ring peaks 46, 48. The ring 30 is engaged in adjacent contact with the channel 22 defined under the collar 20. The bucket handle 32 is engaged with the ring 30 at points of engagement. Ring peaks 46, 48 of ring 30 constitute points of engagement 50, 52 for engaging the first 42 and second 44 terminal ends of the bucket handle 32. The ring 30 is in closer proximity to the open top 14 than the bottom wall 12 of the bucket body 10, and since gravity is still acting on the bucket contents urging the weight of the bucket 10 downward toward the bottom wall 12, this leads to greater stability of the bucket 10 when it is being lifted.

Figure 5:
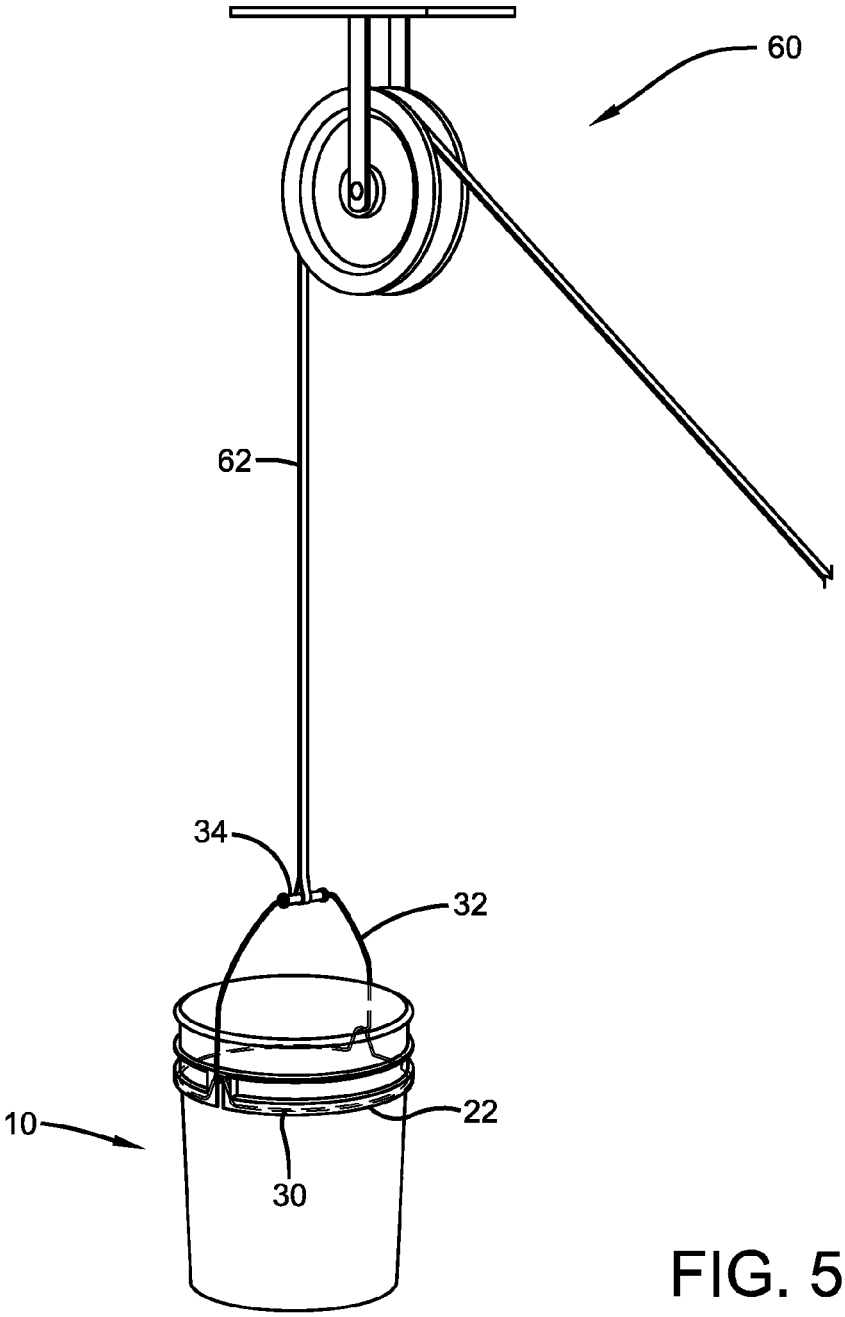
FIG. 5 is a view of the bucket of the present embodiments attached to a pulley.

FIG. 5 shows the bucket 10 attached to a pulley system 60. The pulley 60 includes a belt 62. The pulley 60 is used by applying a downward force on the belt 62. The belt 62 is attached to the bucket handle 32 of the bucket 10 at or near the center griping region 36 of the handle 32. When downward force is applied to the belt 62 of the pulley 60, the handle 32, engaged with the ring 30 at the points of engagement 50, 52 applies an upward force on the bucket 10. The force applied via the belt 62 is substantially evenly distributed around the collar 20 by the ring 30.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

The invention claimed is:

1. A bucket comprising:

a bucket body including an upstanding continuous sidewall, a bottom wall, an open top, an interior, and an exterior surface, wherein said bottom wall and said open top define a distance therebetween;

a collar extending outwardly from said exterior surface and around the perimeter of said bucket body, wherein said collar includes upstanding slots and wherein said collar is located between from about 50% to about 100% of said distance from said bottom wall;

a channel on said exterior surface of said bucket body and adjacent said collar, wherein said channel is substantially L-shaped;

a ring engaged with said channel; and a handle comprising first and second ends, wherein said handle is pivotably engaged to said ring and wherein said first and second ends are inserted into said upstanding slots.

2. The bucket of claim 1, wherein said a cross section of said bucket body is circular.

3. The bucket of claim 2, wherein said collar comprises an annular collar extending outwardly around the perimeter of said bucket body.

4. The bucket of claim 3, wherein said collar comprises an open bottom facing toward the bottom wall of said bucket body.

5. The bucket of claim 4, wherein said channel comprises an annular channel defined between said exterior surface of said bucket body and said annular collar.

6. The bucket of claim 3, wherein said upstanding slots of said annular collar are defined by a border comprising two collar portions extending upwardly above an upper horizontal margin of said annular collar and a connection portion extending between the upper ends of said upwardly extending collar portions.

7. The bucket of claim 6, wherein said border defining the axially aligned upstanding slots also defines a continuous channel between said exterior surface of said bucket body and an inner surface of said collar facing said exterior surface of said bucket body.

8. The bucket of claim 7, wherein said continuous channel defined by said border is continuous with remainder of said annual collar extending about said exterior surface of said bucket body.

9. The bucket of claim 8, wherein said ring is circular and is engaged with said annular channel.

10. The bucket of claim 9, wherein said ring comprises at least two semicircular sections and at least two axially aligned ring peak sections.

11. The bucket of claim 10, wherein said ring peak sections extend upwardly from an upper horizontal margin of said ring.

12. The bucket of claim 11, wherein said ring peak portions comprise ring portions extending upwardly and inwardly within a plane from an upper horizontal margin of said ring and wherein said ring peak portions connect at an apex.

13. The bucket of claim 12, wherein said handle is substantially arcuate shape.

14. The bucket of claim 13, wherein said arcuate handle comprises a gripping region, arms extending from said opposite ends of said gripping regions, and first and second ends.

15. The bucket of claim 1, wherein said collar is located between from about 60% to about 95% of said distance from said bottom wall.

16. The bucket of claim 1, wherein said a cross section of said bucket body is square.

* * * * *